US008411891B2

(12) United States Patent
Del Prete

(10) Patent No.: US 8,411,891 B2
(45) Date of Patent: Apr. 2, 2013

(54) GARMENT WITH INTEGRATED EARPHONES

(76) Inventor: Antonio Del Prete, Beverly Hills, CA (US)

( * ) Notice: Subject to any disclaimer, the term of this patent is extended or adjusted under 35 U.S.C. 154(b) by 199 days.

(21) Appl. No.: 13/024,191

(22) Filed: Feb. 9, 2011

(65) Prior Publication Data

US 2012/0201412 A1 Aug. 9, 2012

(51) Int. Cl.
*H04R 25/00* (2006.01)

(52) U.S. Cl. ..... 381/333; 381/301; 381/388; 2/905

(58) Field of Classification Search ..... 381/301, 381/333, 338, 388; 2/69, 905
See application file for complete search history.

(56) References Cited

U.S. PATENT DOCUMENTS 5,563,951 A * 10/1996 Wang et al. ..... 381/301
6,243,870 B1 6/2001 Graber
7,035,422 B1 4/2006 Wiener
7,519,192 B1 4/2009 Laycock
7,673,348 B2 3/2010 Williams
2003/0144039 A1* 7/2003 Lin ..... 455/568
2006/0062413 A1* 3/2006 Wehrell ..... 381/301
2006/0075537 A1 4/2006 Tsai
2010/0329499 A1 12/2010 Wolfe
2011/0019861 A1 1/2011 Wolfe
2011/0129110 A1 6/2011 Wolfe

* cited by examiner

*Primary Examiner* — Suhan Ni
(74) *Attorney, Agent, or Firm* — Marc E. Hankin; Kevin Schraven; Hankin Patent Law, APC

(57) ABSTRACT

The invention is a garment with an integrated earphone, headset, and wire. The wire allows an audio signal to travel from an electronic device at one end of the wire to the earphone or earphones, and/or a microphone at the other end of the wire. The wire, or wires, is preferably permanently sewn into the seams of the garment. The earphone may be retractable and/or kept in a small pocket near the collar of the garment to limit the movement of the earphone when it is not being actively used. The integrated earphone and microphone are preferably machine washable and dryable along with the garment with which they are integrated.

10 Claims, 7 Drawing Sheets

GARMENT WITH INTEGRATED EARPHONES

FIELD OF THE INVENTION

The present invention relates to a garment with integrated earphones and earphone wires. The integrated wires connect to an electronic device, such as a smart phone or digital music player and allow the user to have readily accessible earphones or ear buds with which to hear the music or use the smart phone. When the garment is used with a smart phone or cellular phone, the integrated wires may also include a microphone. The earphones are retractable into the garment and the earphone wires run within the seams of the garment. The integrated earphones and microphone are machine washable and dryable along with the garment with which they are integrated.

BACKGROUND

Electronic devices, such as smart phones, digital music players, compact disc players, cellular phones, have exploded in popularity over the last twenty years. These electronic devices have become smaller and more portable, which has allowed users to take the devices everywhere. The portable electronic device can be worn by the user at their waist, strapped to their arm, or within a jacket or pants pocket. Typically, the speaker systems on the portable electronic devices are not powerful enough to allow users to enjoy playing sounds using the speaker. Instead, users frequently use detachable headphones, ear buds, or earphones, which plug directly into the portable electronic device.

Unfortunately, using loose and detachable earphones cause several problems, including that the wires get tangled with the user, the user's clothing, or the user's environment. This results in the earphone wires getting pulled out of the portable electronic device or the ear phones being pulled out of the ears of the user. Additionally, the loose wires are generally unsightly to the chosen fashion of the user.

In an attempt to corral the wires and prevent the unsightly and unfashionable appearance of the wires, many users try to hide the earphone wires by placing them underneath an article of clothing. But this solution causes more problems than it solves because the wires are even more easily pulled out of the ears or portable electronic device by a movement of the user. Further, when the wires are pulled out, the user must fish around under their clothing to retrieve the end of the wire or the earphones. In addition, when the user wants to remove the ear phones for a brief moment, the ear phone is left dangling, in an unsightly manner, on the outside of the clothing. Finally, although putting the wires underneath an outer garment, like a sweatshirt or jacket, might provide some benefit to the user, wearing the wires next to the skin, underneath a single layer garment, such as a t-shirt, is simply not comfortable. As such, hiding the wires underneath clothing is not a practical solution, especially in warm weather, when the user is not wearing an outerwear garment.

Several references disclose products that have attempted to solve the problem of unsightly and unruly dangling earphone wires. For example, U.S. Published Patent Application Number (USPPAN) 2010/0329499, filed by Wolfe, and U.S. Pat. No. (USPN) 7,519,192, issued to Laycock, disclose and claim a hooded sweatshirt with drawstrings, wherein the earphone wires are incorporated into a channel, tube, "passageway," or casing that is attached to the interior of the garment. FIG. 4 of the Wolfe application shows tube 42, which contains the wires 16. FIGS. 1 and 2 of the Laycock patent show that the wires are contained within "passageways" 126, 134, and 136. Both the Wolfe and Laycock earphones themselves are disclosed and claimed as being at the end of, and contained within, the hood's drawstrings. As such, when the user is listening to music using these products, it looks as if the user, rather oddly, has the drawstrings stuck into his or her ears. Therefore, the Wolfe and Laycock references offer a relatively silly looking solution to the problem and they fail overcome all of the problems with having loose head phone wires. Importantly, the Wolfe and Laycock references also fail to disclose a garment that has an integrated earphone and microphone wire set for use with a cellular phone or smart phone.

Another example of a garment that attempts to solve the problem of loose earphone wires is U.S. Pat. No. ("USPN") 7,673,348, issued to Williams. Williams discloses and claims a garment with "sleeve" portion that is configured from an additional swatch of material that is attached to a standard garment. This sleeve portion is itself unsightly, unfashionable, and clearly visible. Additionally, Williams does not disclose that the earphone and earphone wires are integrated into the garment, or that the earphones may be left attached to the garment when the garment is washed. As such, Williams fails to provide a complete and fashionable solution to the problem of loose earphone wires.

USPPAN 2006/0075537, filed by Tsai, discloses and claims a jacket with various pockets and slots that hold a portable electronic device and allow for passage of earphone wires. The Tsai jacket essentially solves the loose wire problem by cutting holes in the jacket and running the wires through the holes. Tsai does not disclose that the earphone and earphone wires are integrated into the garment, or that the earphones may be left attached to the garment when the garment is washed. As such, Tsai fails to provide a complete and fashionable solution to the problem of loose earphone wires.

There is no reference or currently available garment that includes integrated earphones and an earphone wire that is fashionable, machine washable and dryable, and wherein the wires are virtually undetectable by the garment wearer.

Thus, what is needed is a garment that provides a complete, functional, and fashionable solution to incorporating concealed earphone wires into any article of clothing and that does not require the addition of a tube, or excess material passageway and wherein the wire is virtually undetectable by the wearer of the garment.

SUMMARY OF THE INVENTION

To minimize the limitations in the prior art, and to minimize other limitations that will become apparent upon reading and understanding the present specification, the present invention relates to a garment with an earphone wire integrated into the garment, instead of adding an additional channel or casing to the garment. The wire allows transmission from an electronic device at one end of the garment to the earphones at the other end of the garment. The wires are preferably integrated into the seams of the garment so that the wire is completely hidden and the user does not even recognize that the wire is integrated into the garment. The ends of the wire remain exposed so that one end of the wire may connect to an electronic device and the other end of the wire, which is typically earphones, are able to be inserted into the ears of the user.

The integrated and concealed wire may also include a microphone that is placed so that the user can make phone calls from a smart phone or cellular phone. The earphones and may be retractable and kept in a small pocket near the collar of the garment to limit the movement of the earphones against the body of the user.

It is an object of the present invention to overcome the numerous limitations of the prior art.

Another object of the present invention is to provide a quality and inexpensive garment that includes integrated in earphones and an earphone wire. The built in earphones and earphone wire eliminates the need of the wearer to provide his or her own earphones, headphones, or other speaker devices when traveling, going to the gym, or driving. The integrated earphones allows the wearer of the garment to enjoy the convenience of the earphones when they are wanted and to quickly and easily retract the earphones when they are not wanted. The integrated earphones prevents a user from forgetting earphones when he or she leaves their home.

It is an object of the invention to provide a garment with an integrated wire, wherein the wire is virtually undetectable by the wearer. In other words, when the wearer has the garment on, he or she cannot readily feel the presence of the wire.

It is another object of the invention to eliminate the illegal and hazardous practice of driving while holding a cellular phone in the driver's hand. Because the earphones and microphone are integrated into the garment, the wearer is never without a hands free device to plug into the phone. Remembering your electronic device, which most people cannot do without these days, is an easy task, but remembering the accompanying accessories, such as earphone is not as easy. By integrating the earphones with the user's clothing, the user will not need to remember to bring the earphone accessories in order to listen to their electronic device.

It is another object of the invention to provide integrated earphones that are easily retractable so that the wire does not catch on equipment and external objects when the user is working, working out, or actively playing. The integrated earphone wire of the present invention does not restrict or limit the movement of the wearer in any way.

One embodiment of the invention is a wearable device with earphones comprising: a garment; one or more earphones; and an earphone wire. The earphone wire is comprised of a middle portion, an earphone end, and a connection end. The earphones are connected to the earphone wire at the earphone end. The garment is comprised of one or more seams, one or more earphone apertures, and a connection end aperture. The middle portion of the earphone wire is integrated within said seams of the garment. The earphone wire preferably exits said garment at the earphone apertures and the connection end aperture. The connection end of said earphone wire connects to an electronic device, which sends an audio signal to the earphones.

Preferably, the earphones are external to the seams of the garment just outside and adjacent to the earphone apertures. The connection end of the earphone wire is external to the seams of said garment just outside and adjacent to the connection end aperture. The earphone wire is preferably slidable and retractable within said one or more seams of said garment. The earphone end of the earphone wire may be retracted proximally within the seams of the garment by pulling the connection end of the earphone wire distally away from the garment, such that the earphones are adjacent, and external to, the earphone apertures of the garment. Further, the connection end of the earphone wire may be retracted proximally within the seams of the garment by pulling the earphone end of the earphone wire distally away from the garment, such that the connection end of the earphone wire is adjacent, and external to, the connection end aperture of the garment.

The wearable device may further comprise one or more earphone pockets and a connection end pocket. The earphone pockets are attached to the garment near or at the earphone apertures, such that when the earphone end of the earphone wire is retracted within the seams of the garment, the earphones are pulled into the earphones pockets. Additionally, the connection end pocket is attached to the garment at or near the connection end aperture, such that the connection end of the earphone wire is stored within the connection end pocket when the earphone end of the earphone wire is retracted within the seams of the garment. Preferably the earphone wire is permanently sewn into the seams of the garment. The earphone wire and the earphones are fully machine washable and dryable, no special washing procedures are needed.

The earphone wire may also include a microphone so that if the user is using a cellular phone the garment with earphones can be used as a hands free headset.

Another embodiment of the invention is a wearable device comprising: a garment; a headset; and a headset wire. The headset wire is comprised of a middle portion, a headset end, and a connection end. The headset is connected to the headset wire at the headset end. The headset is comprised of one or more earphones and a microphone. The middle portion of the headset wire is integrated within said garment. The connection end of said headset wire connects to an electronic device, which sends and receives one or more audio signals to and from said headset. The garment is preferably comprised of one or more seams, a headset aperture, and a connection end aperture. The middle portion of said headset wire is preferably integrated within the seams of said garment. The headset wire exits the garment at the headset aperture and the connection end aperture. The headset is external to the seams of said garment at or near the headset aperture and wherein the connection end is external to the seams of said garment at or near the connection end aperture. The said headset wire is preferably slidable and retractable within the seams of the garment. The headset end of said headset wire may be retracted proximally within said one or more seams of said garment by pulling the connection end of said headset wire distally away from said garment, such that said headset is adjacent, and external to, the headset aperture of the garment. The connection end of said headset wire may be retracted proximally within the seams of said garment by pulling the headset end of said headset wire distally away from the garment, such that the connection end of the headset wire is adjacent, and external to, the connection end aperture of the garment. The garment with earphones preferably is further comprised of: one or more headset pockets; and a connection end pocket. The headset pockets are typically attached to the garment at the headset aperture. As the headset end of the headset wire is retracted within the seams of the garment, the headset is pulled into the one or more headset pockets, where it rests comfortably out of the way of the user. The connection end pocket may be attached to the garment at or near the connection end aperture. The connection end of the headset wire is stored within said connection end pocket when said headset end of said headset wire is retracted within said one or more seams of said garment. The headset wire is preferably permanently sewn into the seams of said garment and the headset wire and the headset are machine washable and machine dryable along with the garment.

Another embodiment of the invention is a wearable device comprising: a garment; one or more earphones; and an earphone wire. The earphone wire is comprised of a middle portion, an earphone end, and a connection end. The one or more earphones are connected to the earphone wire at the earphone end. The garment is comprised of one or more seams, one or more earphone apertures, and a connection end aperture. The middle portion of the earphone wire is permanently sewn within the seams of said garment. The earphone wire exits the garment at the earphone apertures and the connection end aperture. The connection end of the earphone wire connects to an electronic device, which sends an audio signal to the earphones. Preferably the earphones are external to the seams of the garment at or near the earphone apertures and wherein the connection end of the earphone wire is external to the seams of the garment at or near the connection end aperture. The garment, earphone wire, and the earphones are preferably machine washable and machine dryable. The earphone wire is typically slidable and retractable within the seams of the garment. The earphone end of the earphone wire is retracted proximally within the seams of said garment by pulling the connection end of the earphone wire distally away from the garment, such that the earphones are adjacent, and external to, the earphone apertures of the garment. The connection end of the earphone wire is retracted proximally within the seams of the garment by pulling the earphone end of the earphone wire distally away from the garment, such that the connection end of the earphone wire is adjacent, and external to, the connection end aperture of the garment.

Other features and advantages are inherent in the wearable device with an integrated wire as claimed and disclosed will become apparent to those skilled in the art from the following detailed description and its accompanying drawings.

DETAILED DESCRIPTION OF THE DRAWINGS

In the following detailed description of the preferred embodiment, reference is made to the accompanying drawings that form a part hereof, and in which is shown, by way of illustration, a specific embodiment in which the invention may be practiced. It is to be understood that other embodiments may be utilized and structural changes may be made without departing from the scope of the present invention.

In the following detailed description of various embodiments of the invention, numerous specific details are set forth in order to provide a thorough understanding of various aspects of one or more embodiments of the invention. However, one or more embodiments of the invention may be practiced without these specific details. In other instances, well-known methods, procedures, and/or components have not been described in detail so as not to unnecessarily obscure aspects of embodiments of the invention.

Figure 1:
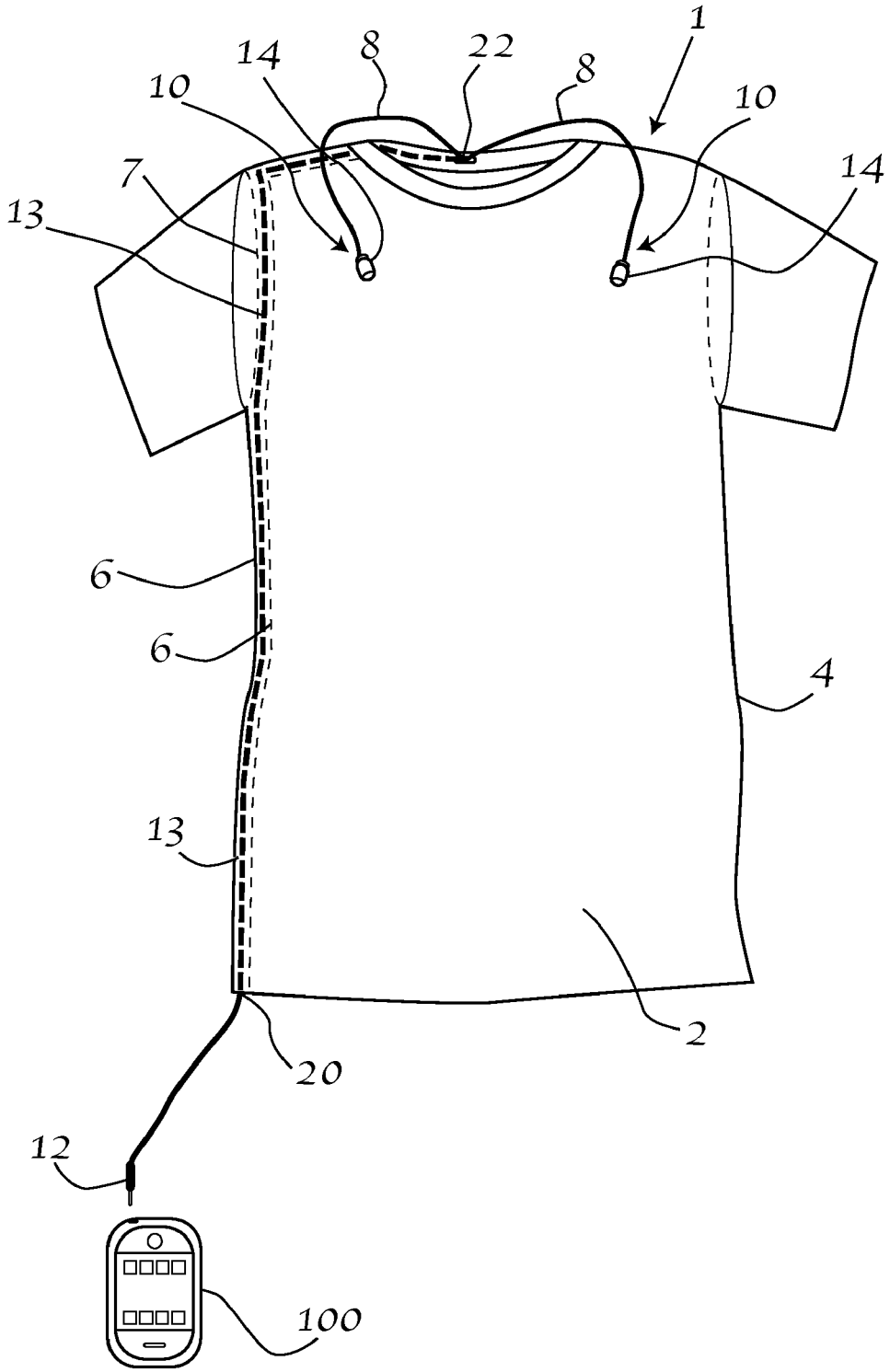
FIG. 1 is an illustration of a front view of one embodiment of the wearable device.

FIG. 1 is an illustration of a front view of one embodiment of the wearable device. As shown in FIG. 1, the garment 1 preferably includes shirt 2, seams 4, 6, and 7, earphone wire 8, earphone ends 10, connector end 12, middle portion 13, earphones 14, connector end aperture 20, earphone aperture 22, and electronic device 100. FIG. 1 shows how earphone wire 8 preferably is comprised of earphone ends 10, middle portion 13, and connector end 12. The middle portion 13 of the earphone wire 8 is preferably integrated into the shirt 2, such that the earphones 14 and earphone wire 8 are not removable from the shirt. In this manner, the earphones are always available to the wearer of the shirt. FIG. 1 also shows how the connector end 12 preferably exits the shirt at connector end aperture 20, which is preferably at a lower region of the shirt 2. Connector end 12 is preferably dangling from the connector end aperture so that it is free for the user to manipulate and plug into electronic device 100. Connector end 12 is preferably a standard male speaker connector (3.5 mm), contact, or pin, which is plugged into a surface-mounted female connector or socket of electronic device 100. When garment 1 is connected to electronic device 100, the wearer is able to listen to the audio signal generated by electronic device 100 through earphones 14, which are connected to earphone wire 8.

Although electronic device 100 is shown as a portable phone or music player, it should be understood that electronic device 100 can be any electronic device, including, but not limited to: a mobile phone; a cellular phone; a smart phone; a computer; a laptop; a tablet computer; an MP3 player; a compact disc player; digital media device; and/or personal digital media device; without deviating from the scope of the invention. Further, although garment 1 is shown as a t-shirt 2, it should be understood that garment 1 can be any article of clothing including, but not limited to, shirt, top, blouse, dress, dress shirt, outerwear garment, overalls, pants, shorts, tank top, sportswear, sports bra, exercise clothing, and/or sleeveless t-shirt, without deviating from the scope of the invention.

FIG. 1 also shows how middle portion 13 is preferably sewn into seam 6 and 7, such that earphone wire 8 is freely slidable within seam 6 and 7. Permanently sewing earphone wire 8 into the seams of shirt 2 results in the wire 8 being completely concealed and virtually undetectable by the user when the user is wearing the shirt. Garment 1 preferably has a clean and fashionable appearance that today's consumers demand in their clothing. Additionally, having wire 8 integrated in the seams of shirt prevents the wire 8 from getting caught or tangled on external objects, and allows the user a full range of movement as the wire 8 slips undetectably back and forth within the seams.

FIG. 1 also shows how earphones 14 exit the shirt at earphone aperture 22, which is preferably on the interior side of the back collar of shirt 2. From this location, the user can easily access earphones 14 and conceal them completely when they are not in use. The apertures 20 and 22 may be in any location on the shirt without deviating from the scope of the invention. Preferably apertures 20 and 22 are located so that they are somewhat concealed and are easily accessible to the wearer of garment 1.

The user can preferably wear, wash, and dry the garment 1 without concern for damaging the earphones or affecting the wiring. As with most articles of clothing, the entire garment 1 is washable without disassembling the garment 1 or removing any part of the present invention.

Seams 4, 6, and 7 may be formed through any type of stitch that will allow the wire 8 to pass through the seam without unduly tugging at the seam, including, but not limited to: plain seam; plain seam bound; plain seam made; French seam; stitched fell; hemmed fell; overhand fell; rolled seam; welt seam; double-stitched welt; cord seam; strapped seam; lapped seam; bonded seams; and/or piquot/picot edge. The stitching technique used preferably conceals the wires within the seam so that they are virtually undetectable by the wearer or a viewer.

Earphones 14 are preferably a small pair of insertable speakers, such as earbuds, which are designed to fit inside of the user's outer ear. However, it should be understood that earphones 14 may be any type of speakers, earphones, earbuds, headset, headphones, stereo phones, and/or mono/stereo speakers without deviating from the scope of the invention. Additionally, the invention may be practiced with any number of earphones, including only one earphone. When a cellular phone or similar communication device is used in conjunction with garment 1, the earphone may contain a combination of earphones and a microphone used for two-way communication. The earphones 14 preferably include at least one sound-producing component or speaker. The frame of the earphone is preferably built around the sound-producing component and will easily fit inside, behind, or around the user's ear. Additional gel cups or rubber can be added for comfort or aesthetics. Earphone wire 8 is typically an audio signal wire that can be made of carbon or composite elements, polymers/plastics, metal, natural, and or synthetic material.

Figure 2:
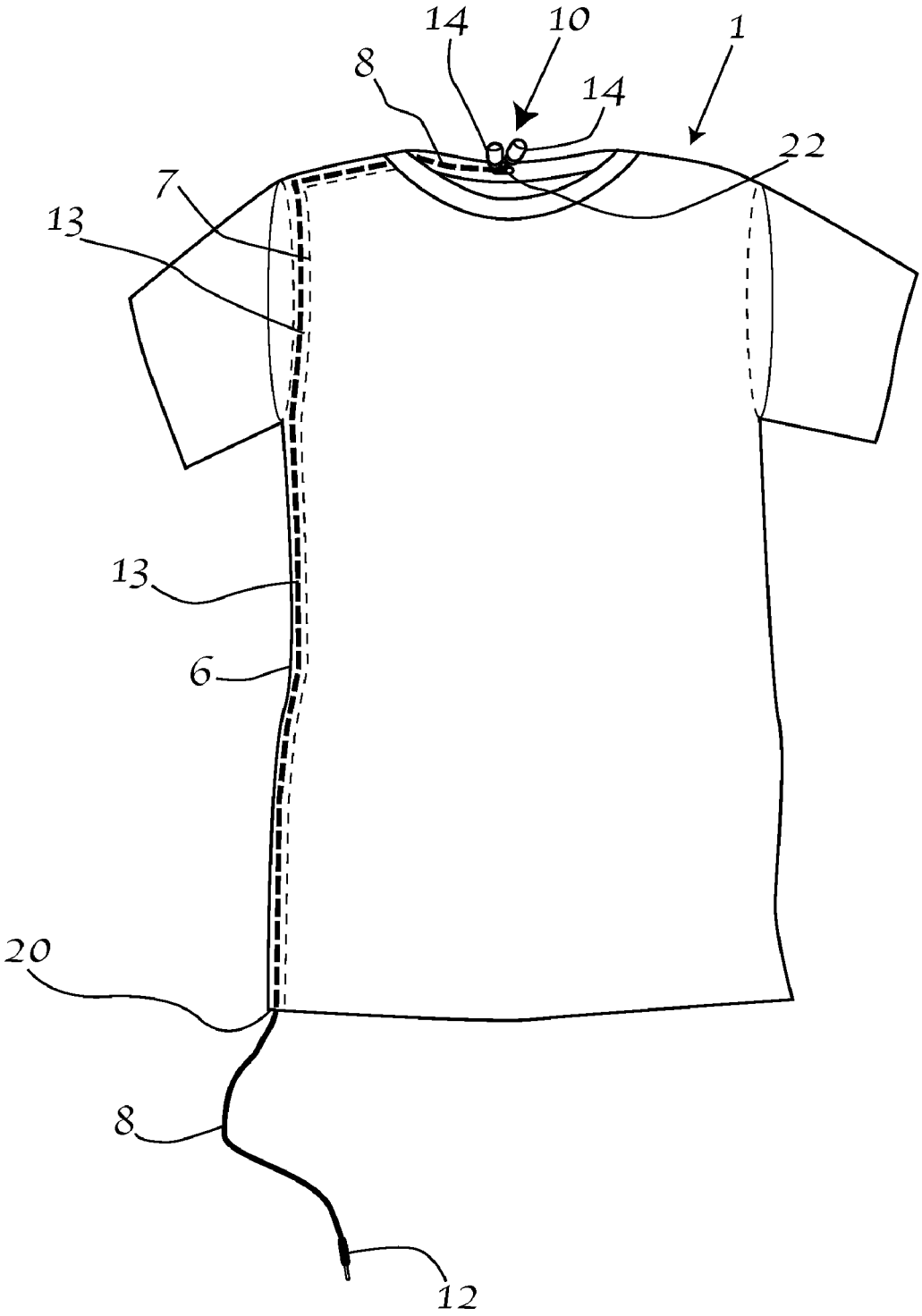
FIG. 2 is an illustration of a front view of one embodiment of the wearable device and shows the earphone wire retracted into the garment.

FIG. 2 is an illustration of a front view of one embodiment of the wearable device and shows the earphone wire retracted into the garment. As shown in FIG. 2, the garment 1 preferably includes seams 6 and 7, earphone wire 8, earphone ends 10, connector end 12, middle portion 13, earphones 14, connector end aperture 20, and earphone aperture 22. FIG. 1 shows how when the user pulls on connector end 12, the middle portion 13 slides within seams 6 and 7, which in turn causes earphone end 10 of wire 8 to retract into earphone aperture 22. In this manner, when the user is not using earphones 14, he or she can move them out of the way by retracting them close to or just outside of earphone aperture 22. FIG. 2 shows how the earphones preferably do not enter into earphone aperture 22, and instead, remain exposed and within the easy reach of the user. The user can then bundle, clip, or store the connector end 12 of wire 8 to prevent it from dangling and being in the way of the user (see FIGS. 6 and 7).

Figure 3:
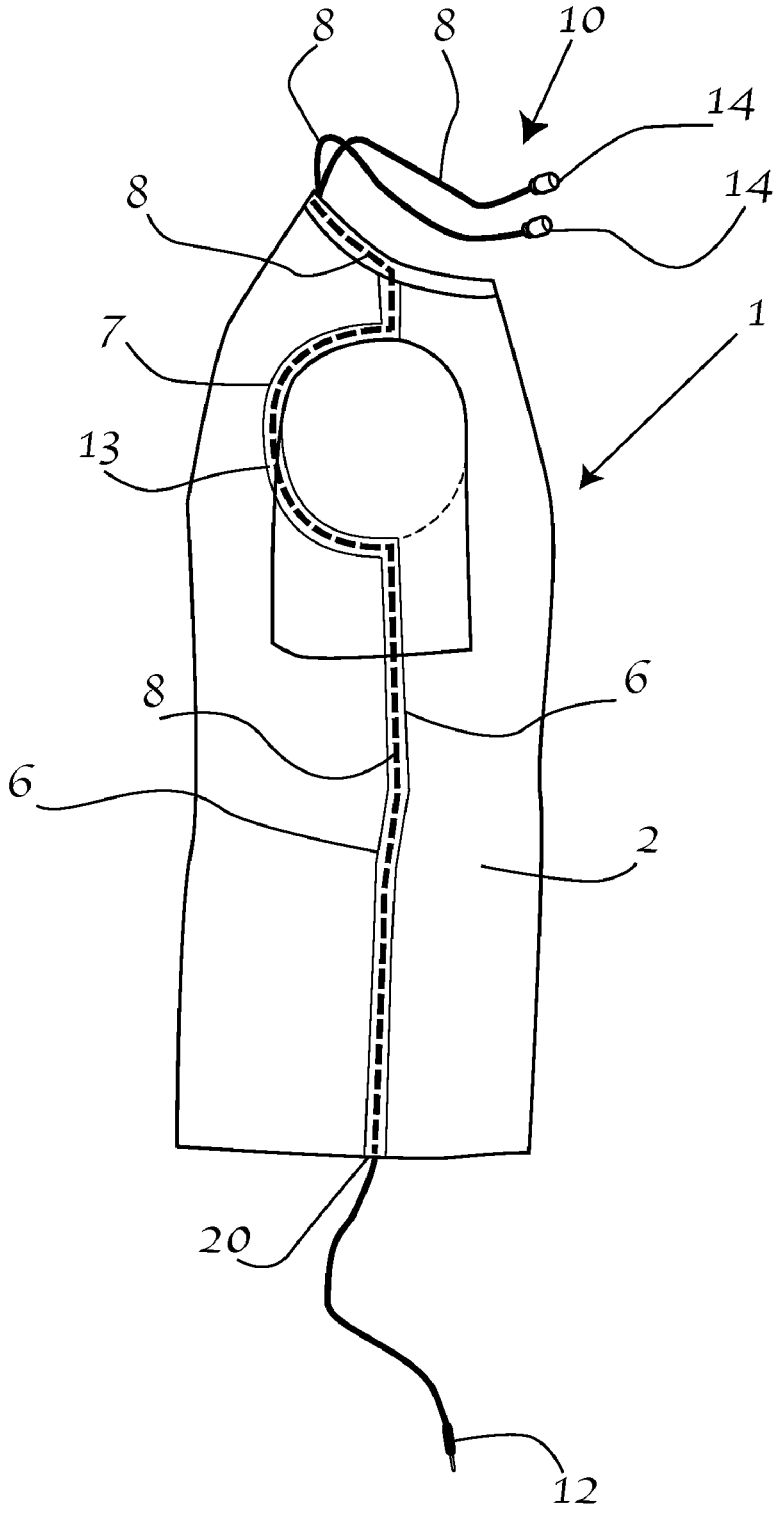
FIG. 3 is an illustration of a side view of one embodiment of the wearable device.

FIG. 3 is an illustration of a side view of one embodiment of the wearable device. As shown in FIG. 3, the garment 1 preferably includes shirt 2, seams 6 and 7, earphone wire 8, earphone ends 10, connector end 12, middle portion 13, earphones 14, and connector end aperture 20. FIG. 3 shows how middle portion 13 of wire 8 runs along the seam behind the arm and exits the seam at the back of the interior portion of the collar. This configuration makes wire 8 less noticeable to the user and to people looking at the wearer of garment 1.

Figure 4:
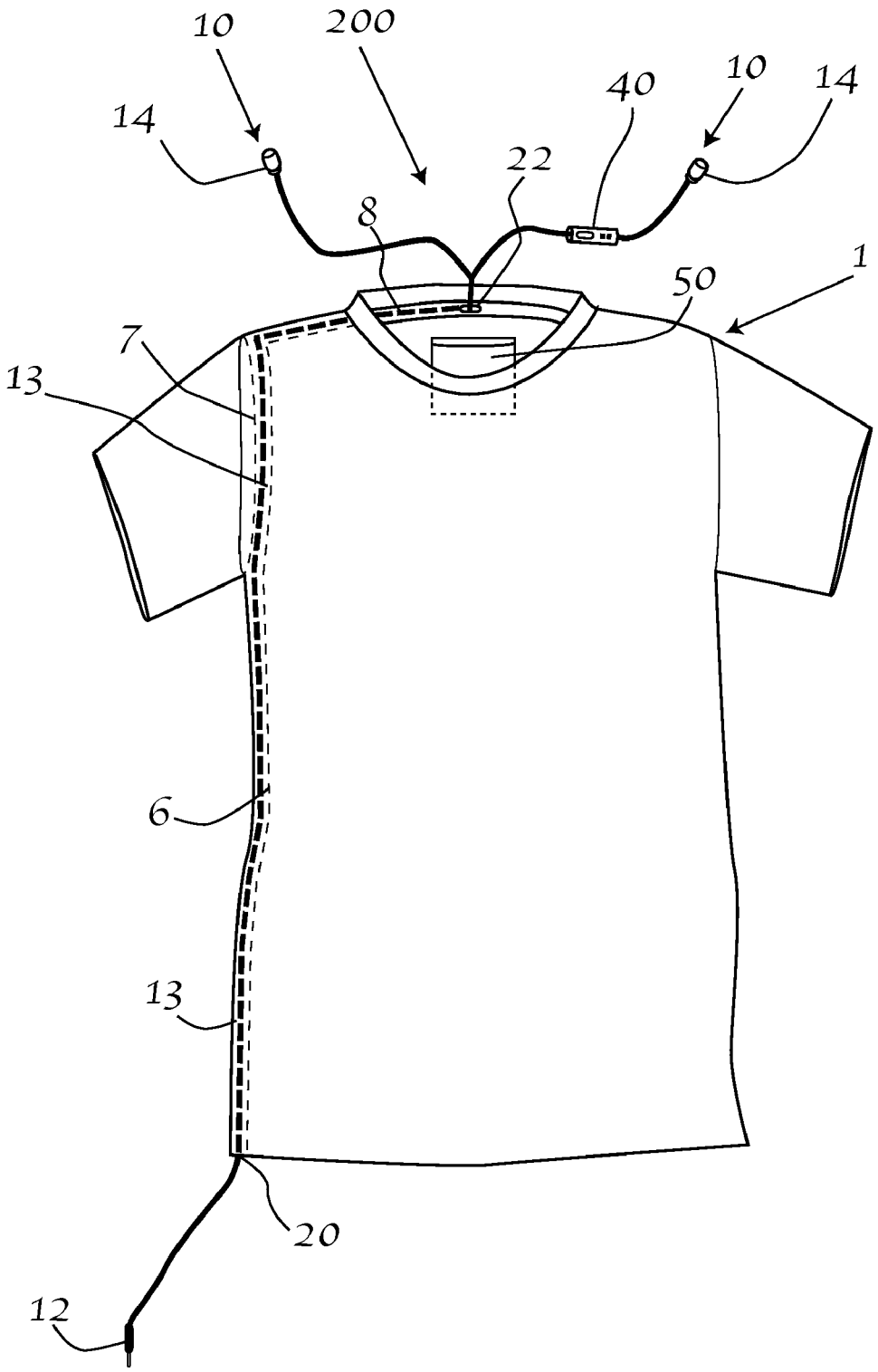
FIG. 4 is an illustration of a front view of one embodiment of the garment with a microphone and showing an earphone pocket.

FIG. 4 is an illustration of a front view of one embodiment of the garment with a microphone and showing an earphone pocket. As shown in FIG. 4, the garment 1 preferably includes seams 6 and 7, earphone wire 8, earphone ends 10, connector end 12, middle portion 13, earphones 14, connector end aperture 20, earphone aperture 22, microphone 40, earphone or headset pocket 50, and headset 200. FIG. 4 shows how the wire 8 may include microphone 40 so that garment 1 may be used as a hands free headset with a cellular or smart phone. Specifically, earphones 14, earphone ends 10, and microphone 40 make up a headset 200. Microphone 40 is preferably located along wire 8 wherein the user's voice will be picked up and transmitted to the cellular phone, to which wire 8 is connected. The headset 200, which includes earphones 14 and microphone 40, is preferably not removable from the garment, and is machine washable and dryable. With this configuration, the wearer of garment 1 will never have to look for a disconnected hands free headset or worry about leaving the hands free headset at home. This is especially important for people who talk on the phone while they drive.

FIG. 4 also shows how garment 1 preferably includes headset or earphone pocket 50. Earphone pocket 50 may be any pouch, clip, slot, or pocket that accepts and removably holds the headset 200, earphones 14, microphone 40, and/or wire 8. FIG. 4 shows that pocket 50 is preferably on the interior of the back of garment 1 and is in close proximity to earphone end aperture 22. Pocket 50 may be in any location on garment 1 without deviating from the scope of the invention.

Figure 5:
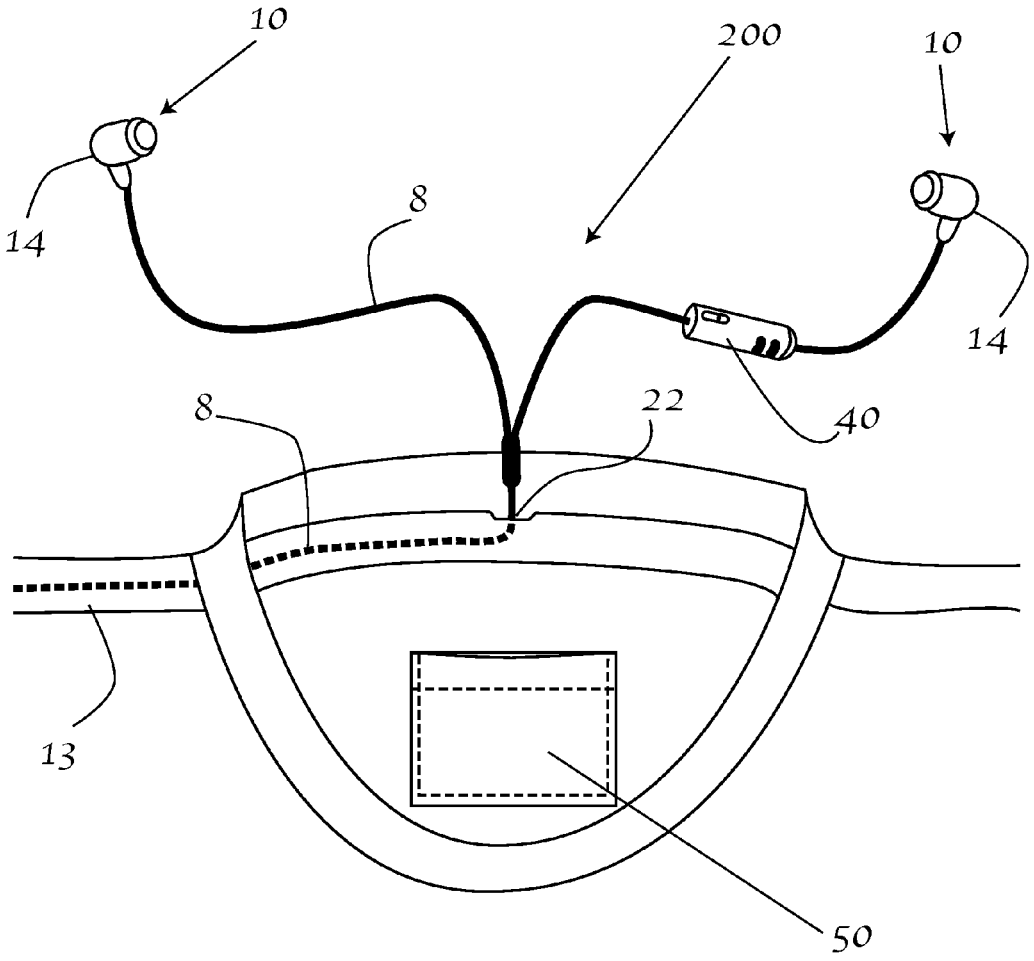
FIG. 5 is an illustration of a close-up front view of one embodiment of the garment.

FIG. 5 is an illustration of a close-up front view of one embodiment of the garment. FIG. 5 shows garment 1 with wire 8, earphone ends 10, middle portion 13, earphones 14, earphone aperture 22, microphone 40, earphone pocket 50, and headset 200. Because the microphone 40, due to its size, may not be able to be pulled into aperture 22, it is preferred that garment 1 include pocket 50. Pocket 50 is preferably designed to comfortably store the headset 200, earphones 14, wire 8, and/or microphone 40, when not in use, and to allow the user to easily and smoothly take back out the headset 200 when desired.

Figure 6:
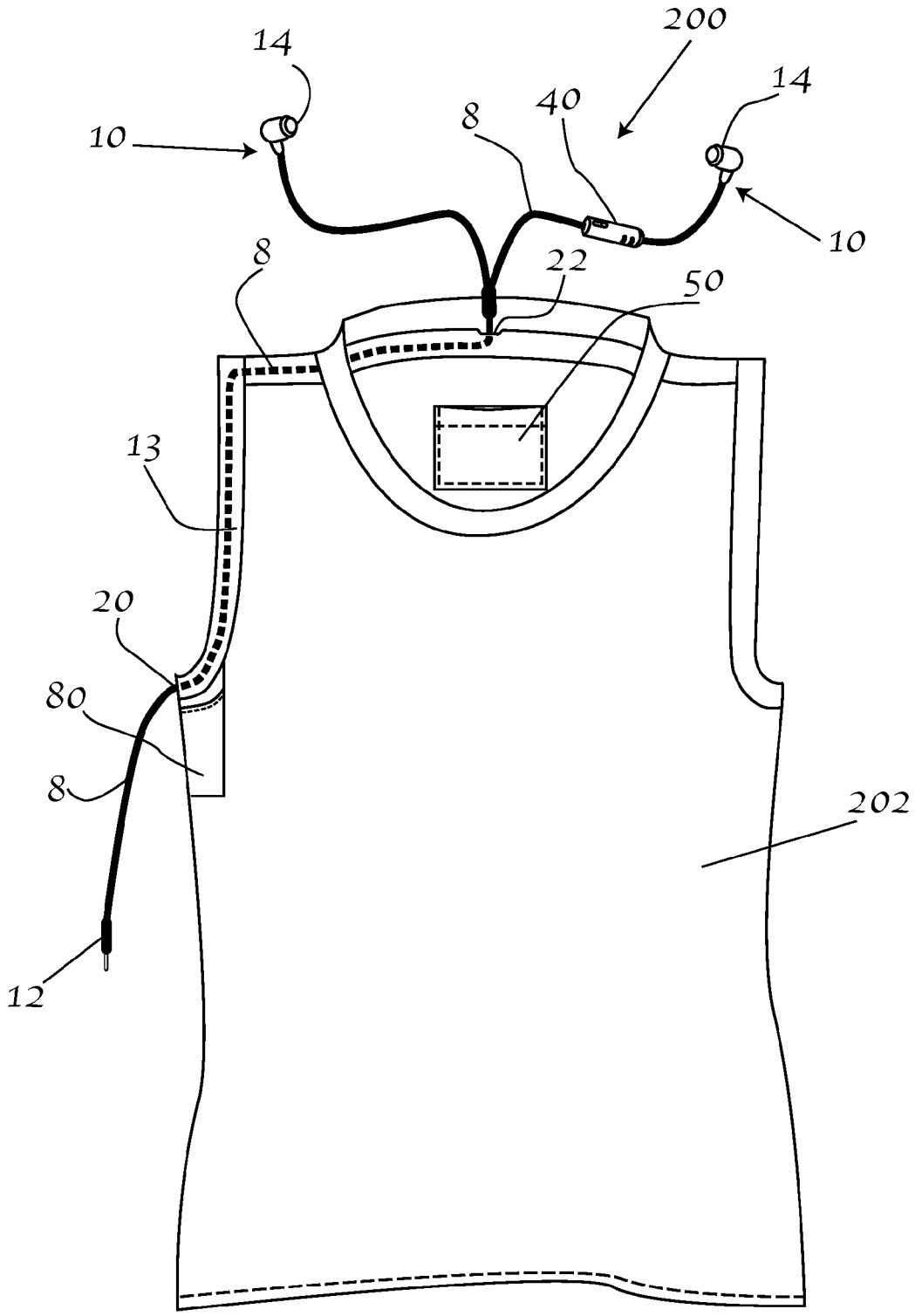
FIG. 6 is an illustration of a front view of one embodiment of a garment with no sleeves and showing a connector end pocket.

FIG. 6 is an illustration of a front view of one embodiment of a garment with no sleeves and showing a connector end pocket. As shown in FIG. 6, the garment 1 preferably includes shirt 202, earphone wire 8, earphone ends 10, connector end 12, middle portion 13, earphones 14, connector end aperture 20, earphone aperture 22, microphone 40, earphone or headset pocket 50, connector end pocket 80, and headset 200. FIG. 6 shows another preferred embodiment of the invention, where the present invention is integrated into a sleeveless work out shirt 202. The garment 1 preferably includes a connector pocket 80 that is able to store the connector end 12 when not in use. This prevents connector end 12 from dangling in an unfashionable manner or getting in the way of the user when they are not actively using the garment to listen to music or make phone calls. FIG. 6 also shows how the connector end aperture 20 may be under the arm, rather than at the tail end of the shirt. The connector end aperture 20 and connector pocket 80 may be in any location on the shirt without deviating from the scope of the invention. Preferably, if connector end aperture 20 is on the bottom and side or tail end of the shirt, pocket 80 will also be near or at the same location.

Figure 7:
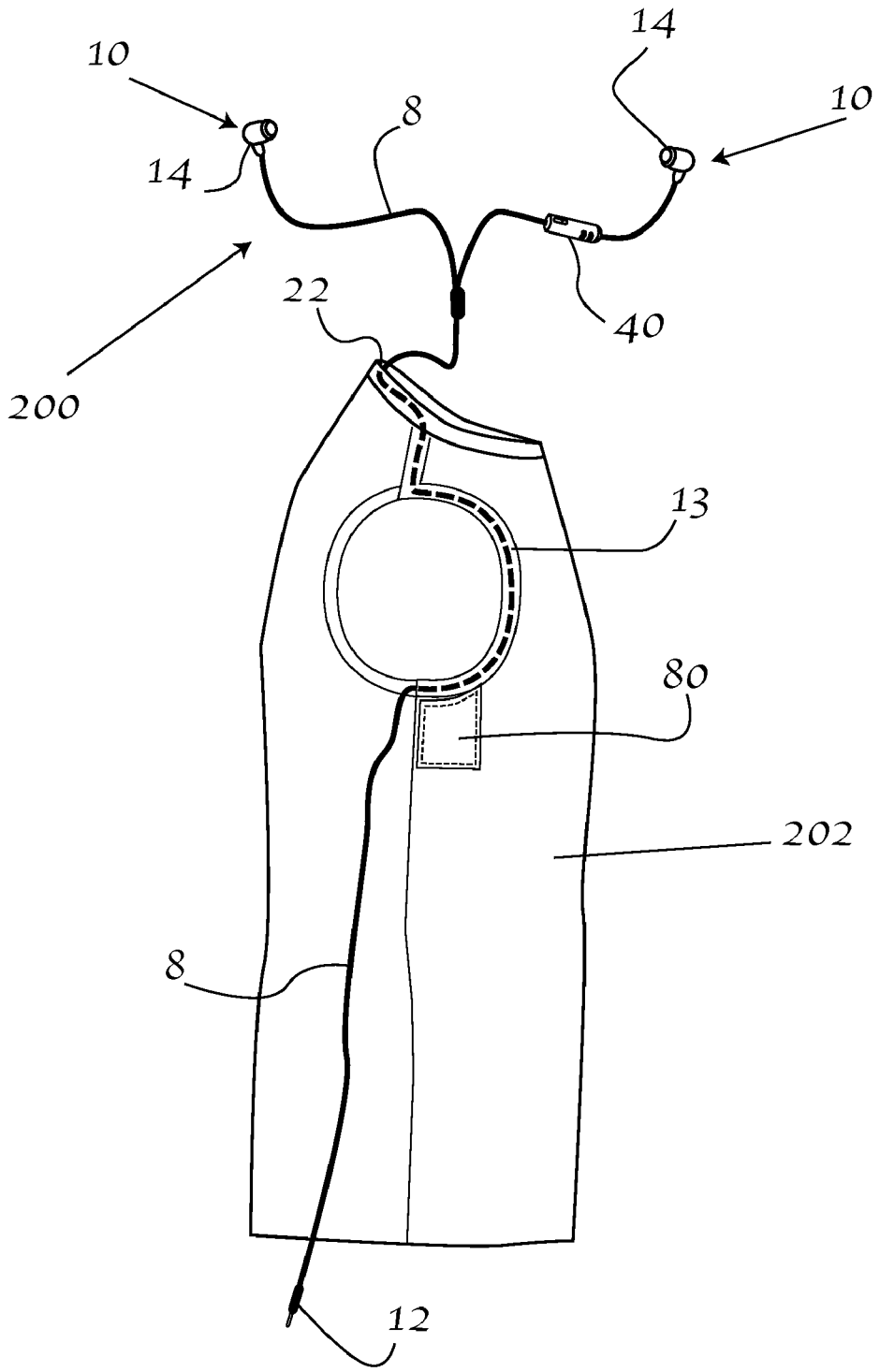
FIG. 7 is an illustration of a side view of one embodiment of a garment with no sleeves and showing a connector end pocket.

FIG. 7 is an illustration of a side view of one embodiment of a garment with no sleeves and showing a connector end pocket. As shown in FIG. 7, the garment 1 preferably includes shirt 202, earphone wire 8, earphone ends 10, connector end 12, middle portion 13, earphones 14, connector end aperture 20, earphone aperture 22, microphone 40, earphone or headset pocket 50, connector end pocket 80, and headset 200. FIG. 7 shows how the connector pocket 80 is preferably adjacent to connector end aperture 20, such that the user may easily bundle and store the connector end 12 when not in use. FIG. 7 also shows how the middle portion 13 of wire 8 may run up the front seam of the shirt 202. Which seams wire 8 is integrated with and/or into depends on the construction and fashionable features of the garment into which it is integrated or sewn. It is desirable to have a wire 8 that is as undetectable as possible by the wearer and viewers.

The foregoing description of the preferred embodiment of the invention has been presented for the purposes of illustration and description. While multiple embodiments are disclosed, still other embodiments of the present invention will become apparent to those skilled in the art from the above detailed description, which shows and describes illustrative embodiments of the invention. As will be realized, the invention is capable of modifications in various obvious aspects, all without departing from the spirit and scope of the present invention. Accordingly, the detailed description is to be regarded as illustrative in nature and not restrictive. Also, although not explicitly recited, one or more embodiments of the invention may be practiced in combination or conjunction with one another. Furthermore, the reference or non-reference to a particular embodiment of the invention shall not be interpreted to limit the scope the invention. It is intended that the scope of the invention not be limited by this detailed description, but by the claims and the equivalents to the claims that are appended hereto.

What is claimed is:

1. A wearable device comprising:

a garment;

one or more earphones;

an earphone wire;

wherein said earphone wire is comprised of a middle portion, an earphone end, and a connection end;

wherein said one or more earphones are connected to said earphone wire at said earphone end;

wherein said garment is comprised of one or more seams, one or more earphone apertures, and a connection end aperture;

wherein said middle portion of said earphone wire is integrated within said one or more seams of said garment;

wherein said earphone wire exits said garment at said one or more earphone apertures and said connection end aperture;

wherein said connection end of said earphone wire connects to an electronic device;

wherein said electronic device sends an audio signal to said one or more earphones;

wherein said one or more earphones are external to said one or more seams of said garment at said one or more earphone apertures and wherein said connection end of said earphone wire is external to said one or more seams of said garment at said connection end aperture;

wherein said earphone wire is slidable within said one or more seams of said garment;

wherein said earphone wire is retractable within said one or more seams of said garment;

wherein said earphone end of said earphone wire is retracted proximally within said one or more seams of said garment by pulling the connection end of said earphone wire distally away from said garment, such that said one or more earphones are adjacent, and external to, said one or more earphone apertures of said garment; and wherein said connection end of said earphone wire is retracted proximally within said one or more seams of said garment by pulling the earphone end of said earphone wire distally away from said garment, such that said connection end of said earphone wire is adjacent, and external to, said connection end aperture of said garment.

2. The wearable device of claim 1, further comprising:

one or more earphone pockets; and a connection end pocket.

3. The wearable device of claim 2, further comprising:

wherein said one or more earphone pockets are attached to said garment at said one or more earphone apertures;

wherein when said one or more earphone end of said earphone wire is retracted within said one or more seams of said garment, said one or more earphones are pulled into said one or more earphones pockets;

wherein said connection end pocket is attached to said garment at said connection end aperture;

wherein said connection end of said earphone wire is stored within said connection end pocket when said earphone end of said earphone wire is retracted within said one or more seams of said garment.

4. The wearable device of claim 3, wherein said earphone wire is permanently sewn into said one or more seams of said garment.

5. The wearable device of claim 4, wherein said earphone wire and said one or more earphones are machine washable and machine dryable.

6. The wearable device of claim 5, wherein said earphone wire is further comprised of a microphone;

wherein said electronic device is a cellular phone;

wherein said microphone and said one or more earphones allows a user to use said cellular phone in a hands free manner.

7. A wearable device comprising:

a garment;

a headset;

a headset wire;

wherein said headset wire is comprised of a middle portion, a headset end, and a connection end;

wherein said headset is connected to said headset wire at said headset end;

wherein said headset is comprised of one or more earphones and a microphone;

wherein said middle portion of said headset wire is integrated within said garment;

wherein said connection end of said headset wire connects to an electronic device;

wherein said electronic device sends and receives one or more audio signals to and from said headset;

wherein said garment is comprised of one or more seams, a headset aperture, and a connection end aperture;

wherein said middle portion of said headset wire is integrated within said one or more seams of said garment;

wherein said headset wire exits said garment at said headset aperture and said connection end aperture;

wherein said headset is external to said one or more seams of said garment at said headset aperture and wherein said connection end is external to said one or more seams of said garment at said connection end aperture;

wherein said headset wire is slidable and retractable within said one or more seams of said garment;

wherein said headset end of said headset wire is retracted proximally within said one or more seams of said garment by pulling the connection end of said headset wire distally away from said garment, such that said headset is adjacent, and external to, said headset aperture of said garment; and wherein said connection end of said headset wire is retracted proximally within said one or more seams of said garment by pulling the headset end of said headset wire distally away from said garment, such that said connection end of said headset wire is adjacent, and external to, said connection end aperture of said garment.

8. The wearable device of claim 7, further comprising:

one or more headset pockets; and a connection end pocket;

wherein said one or more headset pockets are attached to said garment at said headset aperture;

wherein when said headset end of said headset wire is retracted within said one or more seams of said garment, said headset is pulled into said one or more headset pockets;

wherein said connection end pocket is attached to said garment at said connection end aperture;

wherein said connection end of said headset wire is stored within said connection end pocket when said headset end of said headset wire is retracted within said one or more seams of said garment.

9. The wearable device of claim 8, wherein said headset wire is permanently sewn into said one or more seams of said garment; and wherein said headset wire and said headset are machine washable and machine dryable.

10. A wearable device comprising:

a garment;

one or more earphones;

an earphone wire;

wherein said earphone wire is comprised of a middle portion, an earphone end, and a connection end;

wherein said one or more earphones are connected to said earphone wire at said earphone end;

wherein said garment is comprised of one or more seams, one or more earphone apertures, and a connection end aperture;

wherein said middle portion of said earphone wire is permanently sewn within said one or more seams of said garment;

wherein said earphone wire exits said garment at said one or more earphone apertures and said connection end aperture;

wherein said connection end of said earphone wire connects to an electronic device;

wherein said electronic device sends an audio signal to said one or more earphones;

wherein said one or more earphones are external to said one or more seams of said garment at said one or more earphone apertures and wherein said connection end of said earphone wire is external to said one or more seams of said garment at said connection end aperture;

wherein said earphone wire and said one or more earphones are machine washable and machine dryable;

wherein said earphone wire is slidable and retractable within said one or more seams of said garment;

wherein said earphone end of said earphone wire is retracted proximally within said one or more seams of said garment by pulling the connection end of said earphone wire distally away from said garment, such that said one or more earphones are adjacent, and external to, said one or more earphone apertures of said garment; and wherein said connection end of said earphone wire is retracted proximally within said one or more seams of said garment by pulling the earphone end of said earphone wire distally away from said garment, such that said connection end of said earphone wire is adjacent, and external to, said connection end aperture of said garment.

* * * * *